US006868164B2

(12) United States Patent
Ito et al.

(10) Patent No.: US 6,868,164 B2
(45) Date of Patent: Mar. 15, 2005

(54) HEAD PHONE DEVICE

(75) Inventors: Tomohiro Ito, Tokyo (JP); Nobuyuki Takahashi, Gumma (JP)

(73) Assignees: Sony Corporation, Tokyo (JP); Tokumi Electronics Ind. Co., LTD, Gumma (JP)

( * ) Notice: Subject to any disclaimer, the term of this patent is extended or adjusted under 35 U.S.C. 154(b) by 0 days.

(21) Appl. No.: 10/258,208

(22) PCT Filed: Feb. 20, 2002

(86) PCT No.: PCT/JP02/01478

§ 371 (c)(1),
(2), (4) Date: May 8, 2003

(87) PCT Pub. No.: WO02/067624

PCT Pub. Date: Aug. 29, 2002

(65) Prior Publication Data

US 2003/0169897 A1 Sep. 11, 2003

(30) Foreign Application Priority Data

Feb. 20, 2001 (JP) ..... 2001-43876

(51) Int. Cl.[7] ..... H04R 25/00

(52) U.S. Cl. ..... 381/370; 381/374; 381/384; 381/378

(58) Field of Search ..... 381/370, 374, 381/375, 376, 377, 378, 379, 383, 384; 379/430; 181/128, 129

(56) References Cited

U.S. PATENT DOCUMENTS 2,586,644 A * 2/1952 Gilbert ..... 381/382

* cited by examiner

*Primary Examiner*—Huyen D. Le
(74) *Attorney, Agent, or Firm*—Jay H. Maioli

(57) ABSTRACT

Apparatus that prevents the end of a tube that covers a band of a headphone apparatus from being exposed and that, when a cord for transferring an audio signal or the like passes through the tube covering the band, prevents the cord from becoming wound around the band. A headphone apparatus is equipped with a band that is connected to left and right housings to which drivers are directly or indirectly attached and a tube that covers the band and is constructed so that a through-hole, into which the band and tube are inserted, is formed in each of the housings. The headphone apparatus includes fixing members that are inserted into ends of the tube that have been inserted into the through-holes and press the ends of the band against the through-holes. Also, the tube covering the band is constructed so that an internal space is partitioned in a lengthwise direction into two spaces.

4 Claims, 13 Drawing Sheets

HEAD PHONE DEVICE

TECHNICAL FIELD

The present invention relates to a headphone apparatus that is connected to an audio signal source or the like and is used to listen to music or audio. In particular, the present invention relates to a headphone apparatus in a form where the left and right drivers are attached to housings that are joined by a band or bands.

BACKGROUND ART

A headphone apparatus that is such constructed, for example, as shown in FIG. 1 has conventionally been commercialized. FIG. 1 is a frontal view of a listener who is wearing the headphone apparatus. The present headphone apparatus includes a housing 110 that is positioned so as to cover the listener's left outer ear, a housing 120 that is positioned so as to cover the listener's right outer ear, hangers 160 and 160' that support the housings 110 and 120 so that the housings 110 and 120 are freely rotatable, and sliders 180 and 180' that are attached to the upper parts of the hangers 160 and 160', with the sliders 180 and 180' being joined to bands. In FIG. 1, the bands are covered with tubes 131 and 132, which are made of resin, so that the bands cannot be seen from the outside. Both ends of the band that are covered by the tubes 131 and 132 are connected to the sliders 180 and 180' via connecting members 140 and 140'.

FIG. 2 is a side view of the headphone apparatus. FIG. 2 only shows the part that is placed over the listener's left outer ear, though the construction on the right hand side is fundamentally the same. The housing 110 is attached to the hanger 160 so that the housing 110 can rotate about supports 161 and 162, and one end of the slider 180 is attached to a center part 163 of the hanger 160. In this example, the slider 180 is formed of a piece of metal wire that has been bent into a U shape. A resinous connecting member 140 is attached to a midpoint of the slider 180. This connecting member 140 is constructed so as to be able to move along the slider 180 parallel to the slider 180, so that a listener can adjust the position of the bands when wearing the headphone apparatus.

Ends of the bands that are covered with the two tubes 131 and 132 are fixed to the connecting member 140. Also, a cord 170 for transmitting an audio signal between the left and right housings 110 and 120 is passed through one of these tubes (tube 131). As shown in FIG. 2, this cord 170 is exposed to the outside between the connecting member 140 and the hanger 160. Between the hanger 160 and the housing 110, the cord 170 is passed through the inside of the hanger 160.

FIG. 3 shows the internal construction of respective parts of the headphone apparatus when looking from the same side as in FIG. 2. It should be noted that the housing 110 is shown at a position where the housing 110 has been rotated by 90° from the position shown in FIG. 2. A driver 111 that is supplied with an audio signal and outputs sound is provided on the inside of the housing 110. Also, in the present example, a space 112 into which the outer ear is placed is provided at the front of the housing 110.

The cord 170 that extends from the driver 111 provided in the housing 110 passes through the inside of the hanger 160 from the support 162 provided on the hanger 160 and exits the hanger 160 at the center part 163. The cord 170 that extends out of the hanger 160 then enters the connecting member 140.

The connecting member 140 is provided with four screw holes 141 so that a cover member (not shown in the drawings) can be attached with screws. In FIG. 3, the inside of the connecting member 140 is shown with this cover member having been removed. The connecting member 140 in the present example is attached to a midpoint of the U-shaped slider 180, one end of which is attached to the hanger 160, with the connecting member 140 being able to slide along the slider 180 parallel to the slider 180. One end of each of the bands 133 and 134, which are covered with the tubes 131 and 132, are fixed to the connecting member 140. As one example, the bands 133 and 134 can be composed of pieces of metal wire that exhibit elasticity and have 90° bends at their ends. Holes 146 and 147 into which the ends of the bands 133 and 134 are inserted are also provided in the connecting member 140, with the bent ends of the bands 133 and 134 being inserted into these holes 146 and 147 so that the bands 133 and 134 engage the connecting member 140.

FIG. 4 is an enlargement showing how the band 133 is connected to the connecting member 140. The cover member 150 is screwed onto the connecting member 140 using the screw 191. The end of the band 133 that is bent by 90° is inserted into the hole 146 and engages the connecting member 140. Once the cover member 150 has been screwed on, the end of the band 133 is prevented from coming out of the hole, so that the bands 133 and 134 are reliably fixed to the connecting member 140.

When the band 133 is fixed to the connecting member 140, the end 131*a* of the tube 131 that covers the band 133 is received by a concave 142 in the connecting member 140. Consequently, the band 133 cannot be seen from the connecting member 140. Putting this another way, when the band 133 and the tube 131 are attached to the connecting member 140 as shown in FIG. 5, the end 131*a* of the tube 131 is received by the channel 142, so that the band 133 and the cord 170 cannot be seen.

On the other hand, the tube that covers the band is formed of a synthetic resin and is flexible so that it can extend and contract only to a certain degree. As a result, when a force acts so as to pull the tube along the band, there are cases where the end 131*a* of the tube 131 comes out of the connecting member 140, resulting in the band and the cord becoming exposed. FIG. 6 shows an example in which the end 131*a* of the tube 131 has come out of the connecting member 140. As shown in FIG. 6, when a force acts so as to pull the tube 131 along the band, it is relatively easy for the end 131*a* of the tube 131 to come out of the concave 142 in the connecting member 140. Depending on how the user holds the headphone apparatus, this can occur when the user handles the headphone apparatus.

When the tube 131 comes out in this way, the band 133 and the cord 170 that are covered by the tube 131 become exposed, which spoils the appearance of the headphone apparatus. Also, as shown in FIG. 6, the band 133 and the cord 170 become loose in the concave 142 that accommodates the end of the tube 131, so that when the tube 131 is moved to the left or the right (such as in the directions shown as x and y in FIG. 6), the band 133 and the cord 170 are moved to the left and the right inside the connecting member 140, making it easy for the cord 170 to break.

It should be noted that as shown in FIG. 5, it is possible to make it difficult for the end 131*a* of the tube 131 to come out by making the length L1 of the concave into which the end 131*a* of the tube 131 is inserted sufficiently long, though making the length L1 sufficiently long results in a corresponding increase in the size of parts such as the connecting member, causing the problem of an increase in the size of the headphone apparatus. Accordingly, this solution cannot be used for headphone apparatuses which need to be small, such as those used with portable devices. It is also possible to fix the end of the tube 131 to the inside of the connecting member 140 using an adhesive or the like, though in this case also, a relatively long piece of the tube 131 needs to be positioned inside the connecting member 140 so as to ensure that there is a sufficient surface area for applying the adhesive. This makes this solution unsuited to small headphone apparatuses, while the additional need to apply the adhesive during assembly makes the headphone apparatuses more difficult to assemble.

Also, when the cord and band become exposed from the end 131*a* of the tube 131, it becomes possible for the wearer to touch the band and cord. If the user touches the cord, in the worst-case scenario this can result in the cord becoming wound around the band and in deterioration in the arrangement of the cord within the tube. This is not favorable and is another problem for headphone apparatuses.

It should be noted that while a headphone apparatus with the construction that has been described thus far is constructed with a band that is attached to the housings via a connecting member, the same problems as described above are also present with headphone apparatuses with a construction where housings that are worn on the user's left and right outer ears are directly connected to a band that is covered by a tube.

DISCLOSURE OF THE INVENTION

An object of the present invention is to provide a simple construction for preventing the ends of a tube covering a band that connects the left and right housings of a headphone apparatus from coming out.

Another object of the present invention is to prevent a cord that transfers an audio signal or the like from becoming wound around a band that connects the left and right housings of a headphone apparatus, for the case where the cord passes through a tube that covers the band.

A first invention is a headphone apparatus, including two housings which are worn close to left and right outer ears of a listener and to which drivers for outputting sounds corresponding to audio signals are indirectly or directly attached, a band composed of an elastic body that connects the two housings, and a tube that covers the band, wherein a through-hole into which the band and tube are inserted is provided in each of the two housings, and the headphone apparatus includes fixing members that are inserted into ends of the tube that have been inserted into the through-holes and press the ends of the tube against the through-holes.

As a result of doing in this manner, by merely inserting the fixing members into the ends of the tubes, the ends of the tubes become held between the fixing members and the through-holes. Even if a pulling force acts on the tube, the ends of the tubes do not come away from the housing. Therefore, the band or the like that is covered by the tube does not become exposed, which lends an good appearance to the headphone and the problems such as breaking of the cord or the like due to an exposure of the ends of the tube can be eliminated.

A second invention is, in the headphone according to the first invention, to have provided the fixed member with one or a plurality of grooves along the direction of the through-hole in which the tube is inserted.

As a result of doing in this manner, by passing the band and signal wires along the groove or grooves it has become possible to press only the tube against the housing without holding down the band or the like, with the groove or grooves being effectively functional in stopping the tube from coming off.

A third invention is, in the headphone according to the first invention, to pass through the tube the signal wires that supply an audio signal to a driver, with the fixed member being made into a shape whereby part of the tube is pressed against the through-hole and the signal wires being made to pass through the position which is not pressed against the through-hole.

As a result of doing in this manner, it becomes possible to press only the tube against the housing without holding down the cord, leading up to the headphone that is effectively functional in stopping the tube, in which the band and the signal wires are passed through, from coming off.

A forth invention is a headphone apparatus, including: two housings which are worn close to left and right outer ears of a listener and to which drivers for outputting sounds corresponding to audio signals are indirectly or directly attached; a band composed of an elastic body that connects the two housings; a signal wire that connects the two housings; and a tube that covers the band and has an internal space partitioned in a lengthwise direction into two spaces.

As a result of doing in this manner, the tube that covers the band connecting the two housings composing the headphone apparatus has two spaces, so that it is possible to arrange a band and signal wires separately in these two spaces. As one example, this makes it possible to stop the signal wires from becoming wound around the band.

A fifth invention is, in the headphone apparatus according to the forth invention, to have passed the band through one space within the tube while passing the signal wires through the other space.

As a result of doing in this manner, it becomes possible to effectively prevent the signal wires from being wound around the band.

BRIEF DESCRIPTION OF THE DRAWINGS

FIG. 16 are views from three sides showing an example of how a headphone apparatus according to a second embodiment of the present invention is worn, wherein

BEST MODE FOR CARRYING OUT THE INVENTION

Figure 6:
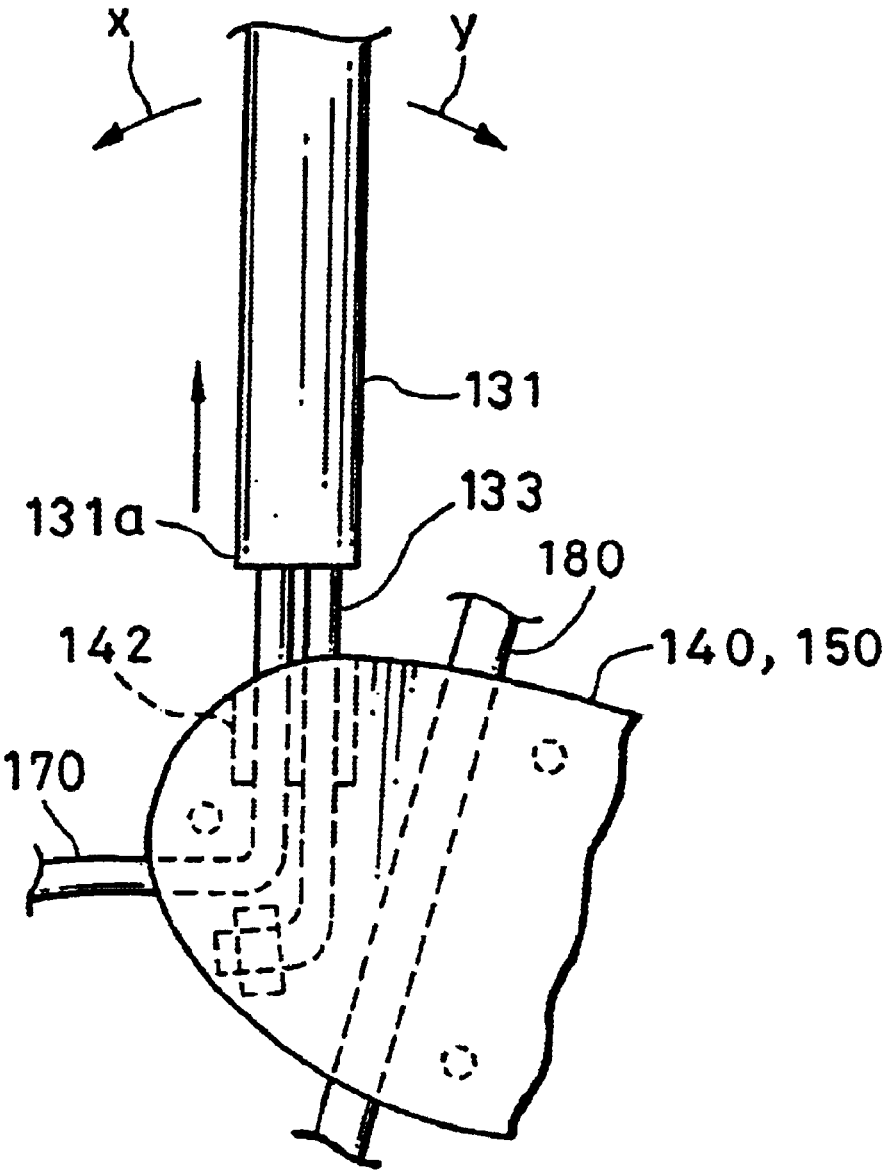
FIG. 6 (PRIOR ART)
FIG. 6 is a frontal elevation showing an example where an end of a tube covering a band of the headphone apparatus shown in FIG. 2 has come away.
Figure 7:
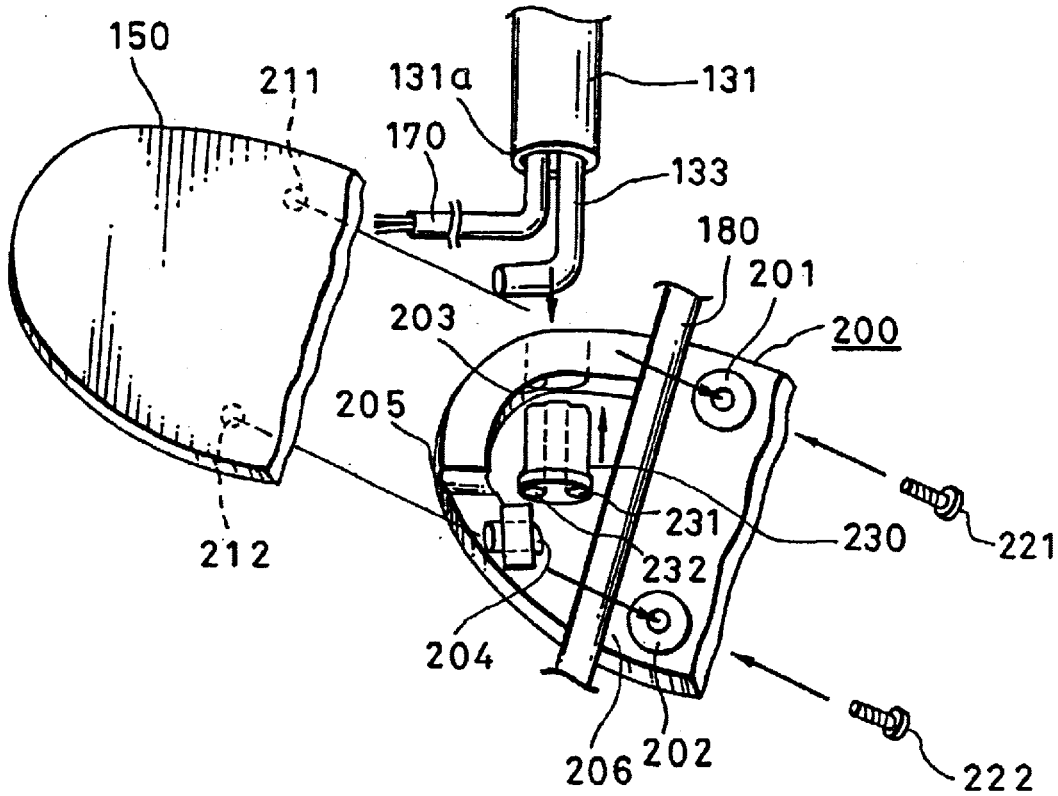
FIG. 7 is a perspective disassembled view showing an example construction of a band fixing part of a headphone apparatus according to a first embodiment of the present invention.
Figure 8:
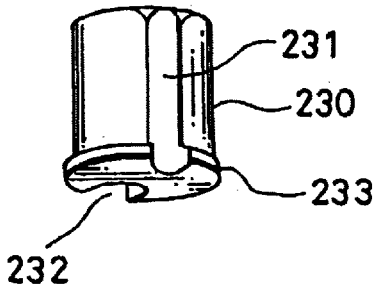
FIG. 8 is a perspective view showing an example construction of a fixing member that is used by a headphone apparatus according to a first embodiment of the present invention.
Figure 9:
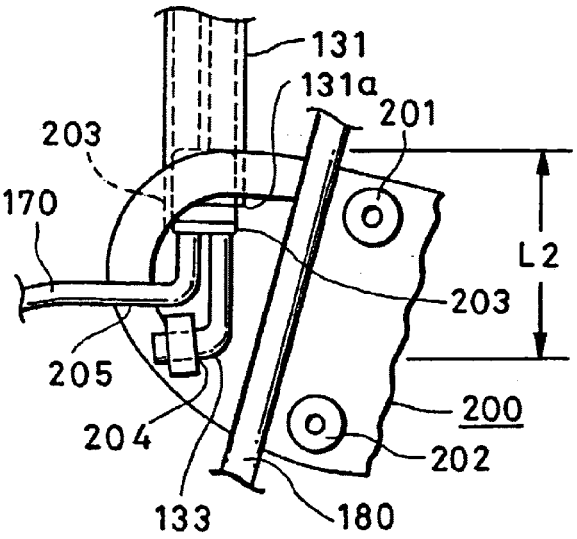
FIG. 9 is a plan view showing how a band connecting part in a headphone apparatus according to a first embodiment of the present invention is assembled.

The following describes a first embodiment of the present invention with reference to the FIGS. 7 to 9. In FIGS. 7 to 9, parts that correspond to the ones of prior art as have been explained in FIG. 1 to FIG. 6 have been given the same reference numerals.

Figure 1:
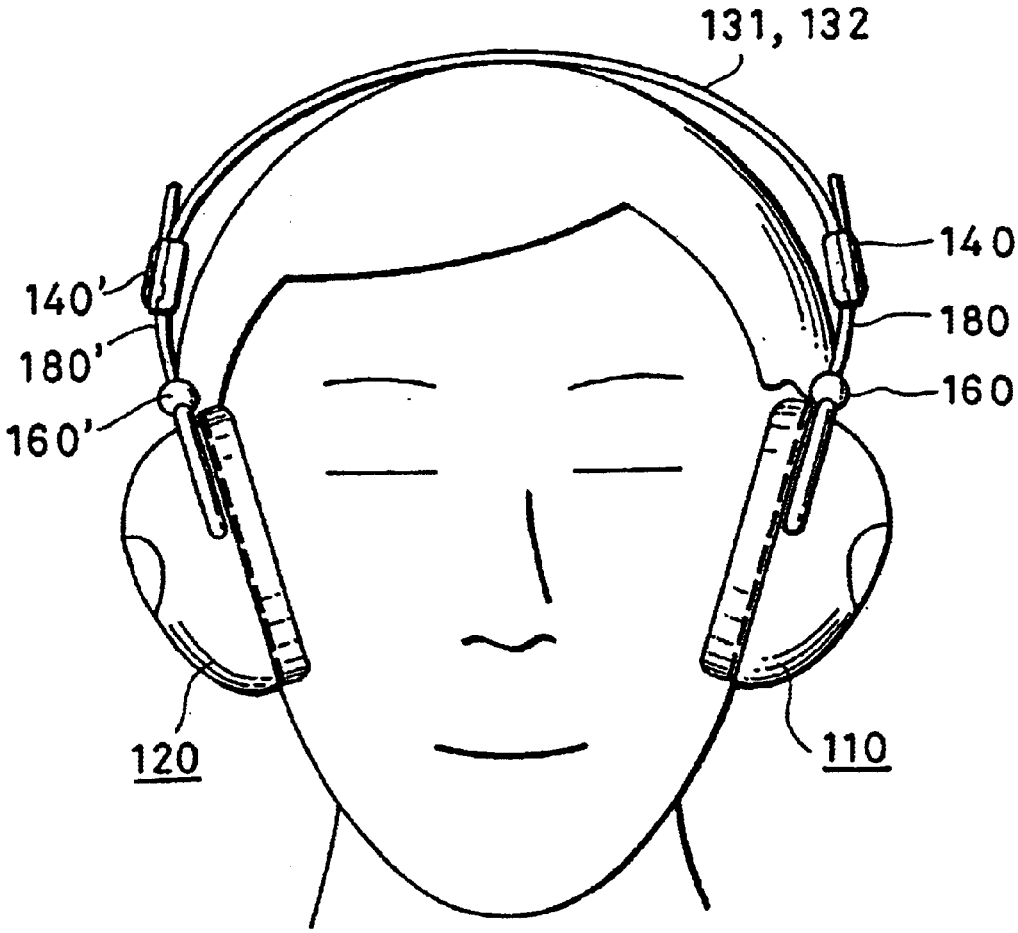
FIG. 1 (PRIOR ART)
FIG. 1 is a plan view showing how one example of a headphone apparatus is worn.
Figure 2:
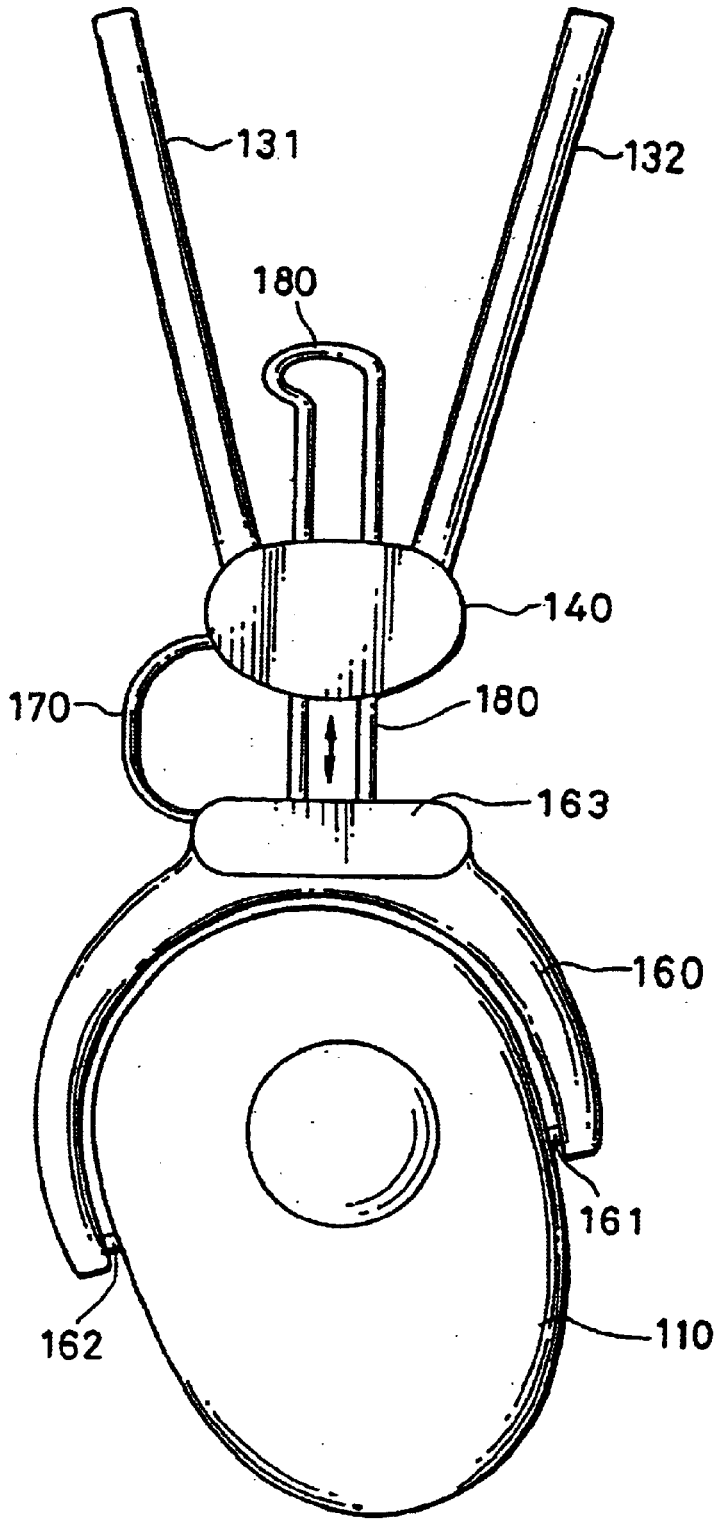
FIG. 2 (PRIOR ART)
FIG. 2 is a side view showing the headphone apparatus shown in FIG. 1.

The present embodiment is applied to the headphone apparatus that is shown in FIGS. 1 and 2 as an prior art example. In other words, as shown in FIG. 1, the present embodiment is applied to a headphone apparatus that includes housings 110 and 120 that are positioned so as to cover the left and right outer ears of the listener, hangers 160 and 160' that support the housings 110 and 120 so that the housings 110 and 120 are freely rotatable, and sliders 180 and 180' that are attached to the upper parts of the hangers 160 and 160', with the sliders 180 and 180' being joined by bands. The bands are covered with tubes that are made of resin and both ends of the bands are connected to the sliders 180 and 180' via connecting members.

Figure 4:
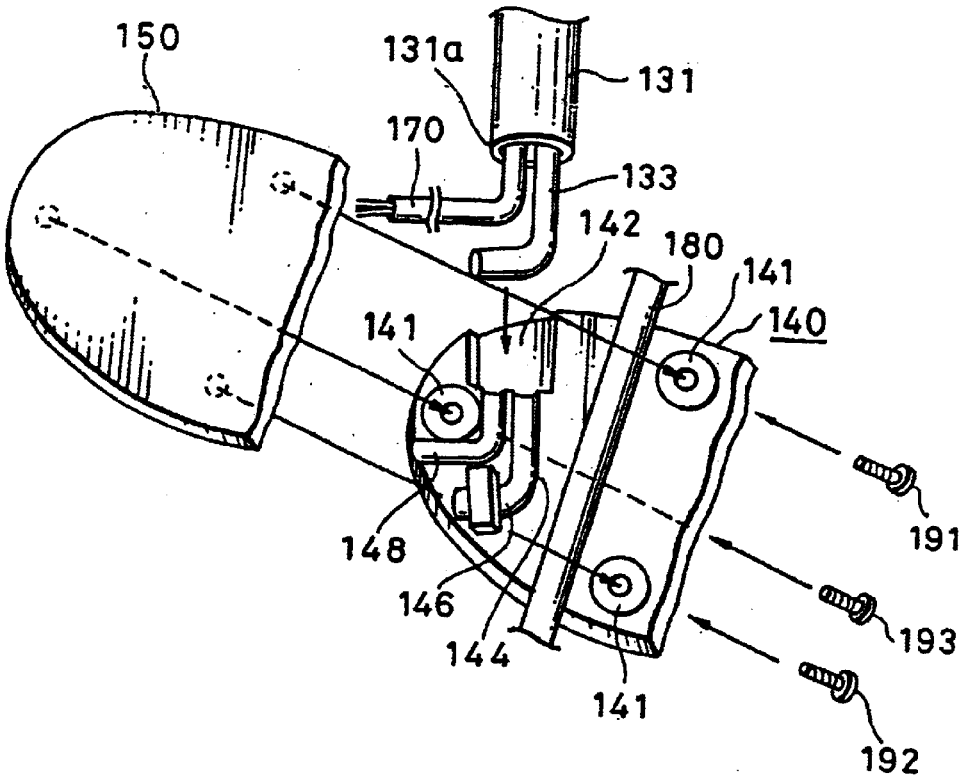
FIG. 4 (PRIOR ART)
FIG. 4 is a perspective view showing an enlargement of the part marked "A" in FIG. 3 once it has been dismantled.
Figure 5:
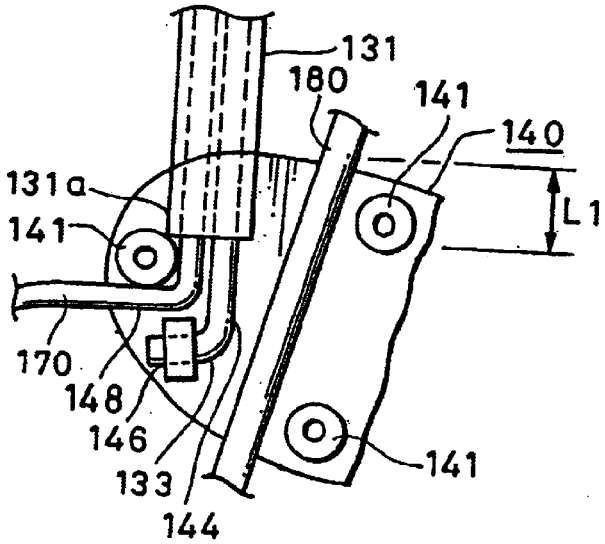
FIG. 5 (PRIOR ART)
FIG. 5 is a plan view showing an enlargement of the inside of the part marked "A" in FIG. 3.

In the prior art example, the connecting member 140 that is shown in detail in FIGS. 4 to 6 is used as the connecting member for connecting the bands 133 and 134 to the sliders 180 and 180'. In the present embodiment, however, a connecting member 200, which is shown in FIG. 7, is used. FIG. 7 shows the principal parts of the connecting member 200. It should be noted that the fundamental form, such as the external appearance, of the connecting member 200 is the same as the connecting member 140 that is shown in the prior art example. As described later, the only difference between the connecting member 200 and the connecting member 140 is the mechanism for fixing the bands 133 and 134. Note that in this embodiment, the components that are attached to the connecting member 200 are given the same reference numerals as in the prior art section.

As shown in FIG. 7, the band 133 that is fixed to the connecting member 200 is covered with a tube 131, with a cord 170 also passing through the tube 131. The tube 131 can be made of a resin, such as polyvinyl chloride (PVC), an elastomer, or rubber, or fiber, for example. The band 133 can be composed of a piece of metal wire that exhibits elasticity and has a 90 bends at its ends. The cord 170 extends into a housing that is not shown in FIG. 1.

The connecting member 200 is assembled by using screws 221 and 222 to screw on a cover member 210 that serves as a cover. For this purpose, the connecting member 200 is provided with screw holes 201 and 202. In FIG. 7, the connecting member 200 is shown with the cover member 150 having been removed. The slider 180 is arranged in a channel 206, and by attaching the cover member 210, the connecting member 200 is held on the slider 180 and is able to move parallel with the slider 180.

A round band-connecting through-hole 203 is provided in the connecting member 200 for attaching the band 133. The band 133 and the cord 170 pass through this through-hole 203 into the inside of the connecting member 200. When the connecting member 200 has been assembled, the tube 131, the band 133, and the cord 170 pass through the through-hole 203, with a fixing member 230 being inserted from an inside of the connecting member 200.

FIG. 8 shows the form of the fixing member 230 in the present embodiment. The fixing member 230 is composed of a substantially cylindrical member with a diameter that is slightly smaller than an internal diameter of the through-hole 203, with a tip of the fixing member 230 being slightly tapered, making it wedge-shaped. Two grooves 231 and 232 that run parallel with the fixing member 230 are formed in the fixing member 230 at opposing positions that are approximately 180 apart. One of these grooves, groove 231, is deeper than a diameter of the band 133, while the other groove, groove 232, is deeper than a diameter of the cord 170. These grooves 231 and 232 may be of an equal depth. Also, in the present example, the fixing member 230 is provided with a small projection 233 that is provided at the back of the fixing member 230 and extends in the circumferential direction. However, this projection 233 is not provided at the parts corresponding to the grooves 231 and 232.

Once the tube 131, the band 133, and the cord 170 have been passed through the band-connecting through-hole 203 in the connecting member 200, the fixing member 230 that is as described above is inserted from the inside of the connecting member 200 into the end of the tube 131 as shown in FIG. 7. When doing so, the band 133 is arranged at the position at which the groove 231 is formed, while the cord 170 is arranged at the position at which the groove 232 is formed.

By inserting this kind of fixing member 230, the tube 131 ends up being sandwiched between the internal wall of the through-hole 203 and the fixing member 230. However, since the band 133 and the cord 170 are arranged at the positions at which the grooves 231 and 232 are formed, the band 133 and the cord 170 are not subjected to strong pressing forces.

FIG. 9 shows the fixing member 230 once it has been inserted in the through-hole 203. The band 133 that extends beyond the end 131*a* of the tube 131 that is sandwiched in the through-hole 203 by the fixing member 230 is inserted in the band engaging hole 204 of the connecting member 200 and is fixed so that the band cannot come loose. In the same way, the cord 170 that extends beyond the end 131*a* of the tube 131 passes through a cord groove 205 provided in the connecting member 200 and exits the connecting member 200.

Since the tube 131 is sandwiched by the inside of the through-hole 203, the end 131*a* of the tube 131 no longer comes out of the through-hole 203 in the connecting member 200, even if the tube 131 is pulled out from the outside of the through-hole 203, for example. Accordingly, the band 133 and the cord 170 that are covered by the tube 131 do not become exposed, which improves the appearance of the headphone apparatus. This also solves the problem of a break in the cord 170 due to the end 131*a* of the tube 131 coming out of the connecting member 200.

Also, the fixing member 230 has a favorable size for insertion in the through-hole 203 of the connecting member 200, so that when the headphone apparatus is assembled as shown in FIG. 9, it is not necessary to provide much space in the connecting member 200 for the fixing member 230. This means that the length L2 from the band-connecting through-hole 203 to the band-engaging hole 204 can be reduced. Putting this another way, as shown in FIG. 5 with a conventional headphone apparatus the part (the concave 142) into which the end 131*a* of the tube 131 is inserted needs to be quite long (the length L1) so as to stop the end 131*a* of the tube 131 coming away from the fixing member, though this length is not required with the present embodiment. As a result, a corresponding reduction can be made in the size of the connecting member 200, which contributes to reductions in size of the headphone apparatus.

Figure 3:
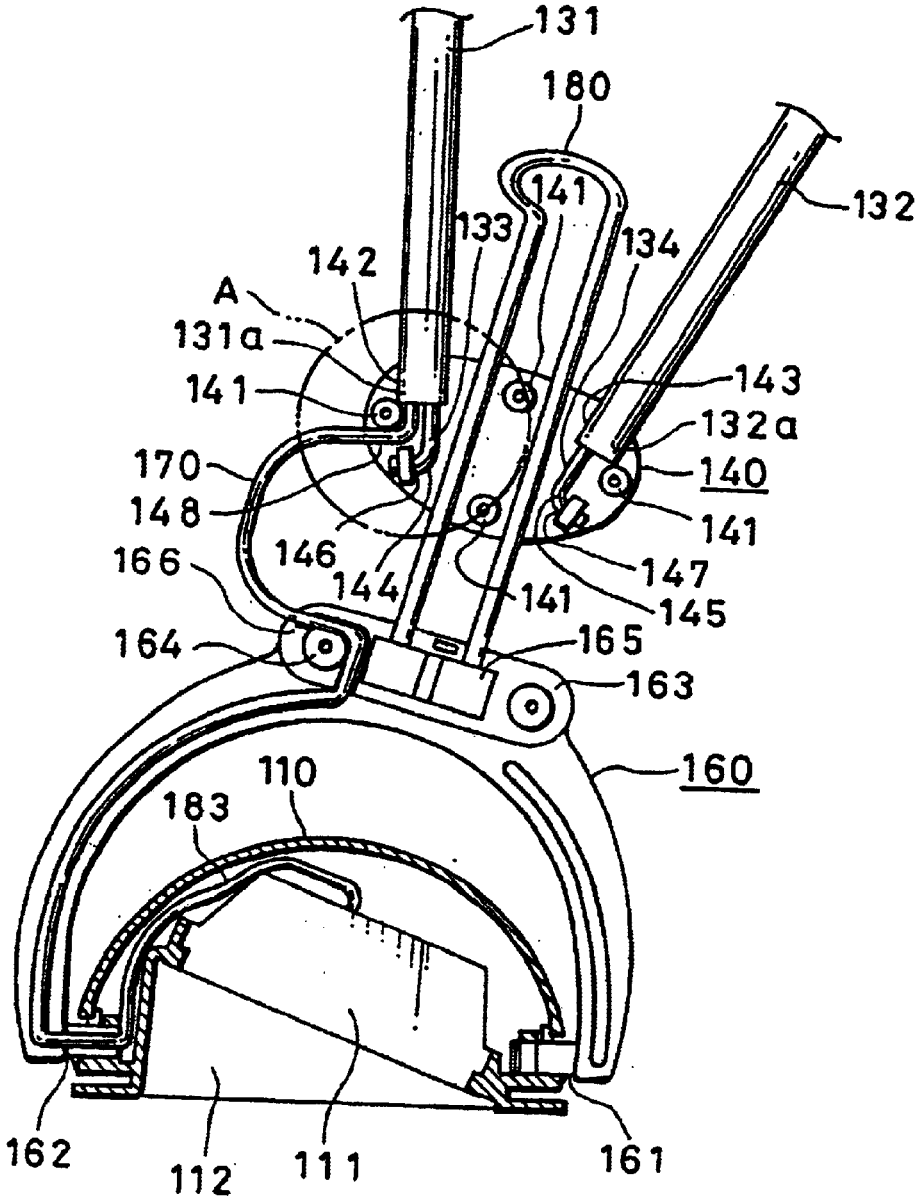
FIG. 3 (PRIOR ART)
FIG. 3 is a side view showing a conventional internal construction of the headphone apparatus shown in FIG. 2.

It should be noted that while the explanation of FIGS. 7 to 9 only describes a fixing construction for one band 133 out of the two bands 133 and 134 that are fixed to the connecting member 200, the fixing construction for the other band, band 134, is exactly the same. However, as shown in FIGS. 2 and 3, there is no need to pass a cord through the tube 132, so that a construction with no groove for a cord and only a groove for allowing the band to pass may be used for the fixing member that is inserted into the through-hole. Alternatively, the same fixing member may be used, i.e., the other band 134 may be fixed using the fixing member 230 (a member with two grooves) that is shown in FIG. 8.

The following describes a second embodiment of the present invention with reference to FIGS. 10 to 16. The present embodiment relates to a neckband-type headphone apparatus, which is to say, a headphone apparatus whose band is positioned behind the listener's head when the listener wears the headphone apparatus. In this headphone apparatus, the ends of the tubes that cover the band are directly fixed to the left and right housings.

Figure 10:
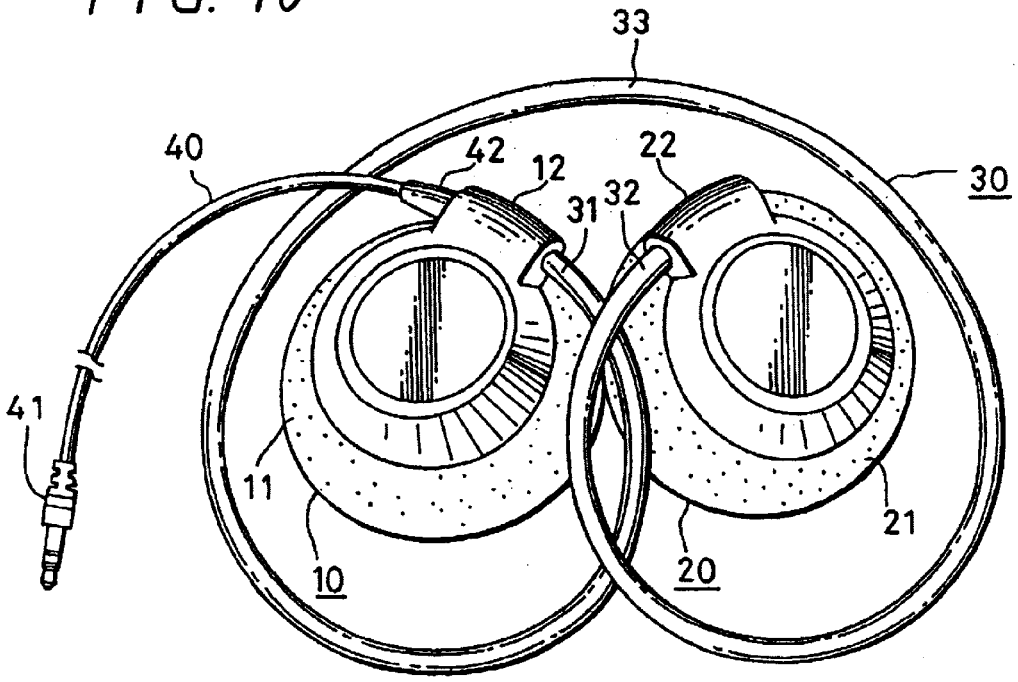
FIG. 10 is a perspective view showing an example of a storage state of a headphone apparatus according to a second embodiment of the present invention.

First, the following describes the overall construction of the headphone apparatus of the present embodiment with reference to FIG. 10. FIG. 10 shows the form of the headphone apparatus of the present embodiment during storage. The headphone apparatus of the present embodiment is formed of a left housing 10 and a right housing 20 that are connected by a tube 30 in the form of a coiled spiral. A band that is formed of a piece of metal wire and a cord for transmitting an audio signal pass through the tube 30. This band is formed of a material that exhibits elasticity and is capable of being extended from its coiled spiral form so that the band is virtually straight.

The other end (bushing 42) of a cord that has a plug 41 for connecting to an audio signal source attached at one end is connected to the left housing 10. This cord 40 is also connected via the cord inside the tube 30 to the right housing 20.

Drivers that are supplied with audio signals and output sound are incorporated in the left housing 10 and the right housing 20. These incorporated drivers are generally of a size where the diameter is up to a few centimeters, with comparatively small examples being in a range of around 9 mm to 16 mm and relatively large examples being around 30 mm in size. When the plug 41 is connected to an audio signal source, the audio signal (sound signal) outputted from the audio sound source is supplied to the drivers in the left housing 10 and the right housing 20 via the cord.

Ear sponge-like pads 11 and 21 are provided on the outsides of the drivers that are provided in the housings 10 and 20. The main body units that serve as the driver retention unit in the housings 10 and 20 are formed of a synthetic resin.

The positional relationship between the housings 10 and 20 and the tube 30 in the present embodiment is as follows. An end 31 of the tube 30 is connected to a band connector 12. The band connector 12 is provided at a position that is eccentric from the center of the substantially circular left housing 10. In the same way, an end 32 of the tube 30 is connected to a band connector 22. The band connector 22 is also provided at a position that is eccentric from the center of the substantially circular right housing 20. The construction by which the band connectors 12 and 22 are fixed to the tube 30 is described later in this specification.

The band that is covered with the tube 30 is in the form of a coil that is wound by around 650 (which is to say, a coil with around 7/4 turns), so that as shown in FIG. 10, the left and right housings 10 and 20 do not overlap one another. The parts near the ends 31 and 32 of the tube 30 that are connected to the left and right housings 10 and 20 are curved with a comparatively small radius, while the central part of the tube 30 is curved with a comparatively large radius, so that the position of one end 31 in the coil is different from the position of the other end 32 in the coil. The state in which the headphone apparatus is worn, whose storage state is shown in FIG. 10, is described later in this specification.

Figure 11:
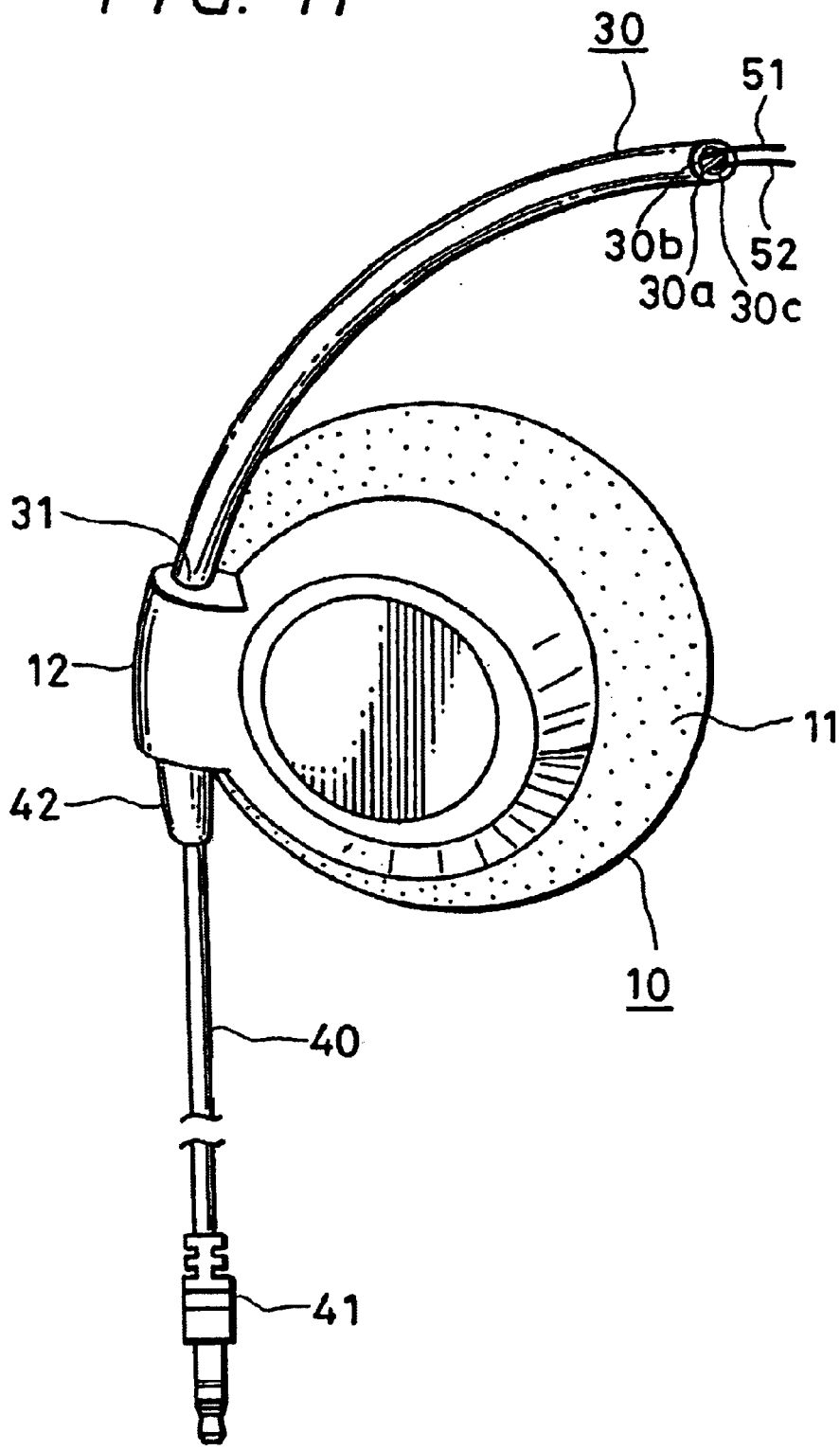
FIG. 11 is a perspective view showing an enlargement of a periphery of a housing on one side of a headphone apparatus according to a second embodiment of the present invention.

FIG. 11 shows the left housing 10 and the periphery. One end of the band 51 that is covered by the tube 30 is fixed to an inside of the band connector 12 of the left housing 10. A cord 52 that is a transmission path for an audio signal also passes through the tube 30. As shown by the cross-sectional part of FIG. 11, a bulkhead 30*a* is formed on an inside of the tube 30 of the present embodiment so as to extend along the length of the tube 30 and partitions the inside of the tube 30 into two spaces. The band 51 passes through one (space 30*b*) of the two partitioned spaces, with the cord 52 passing through the other (space 30*c*).

Figure 12:
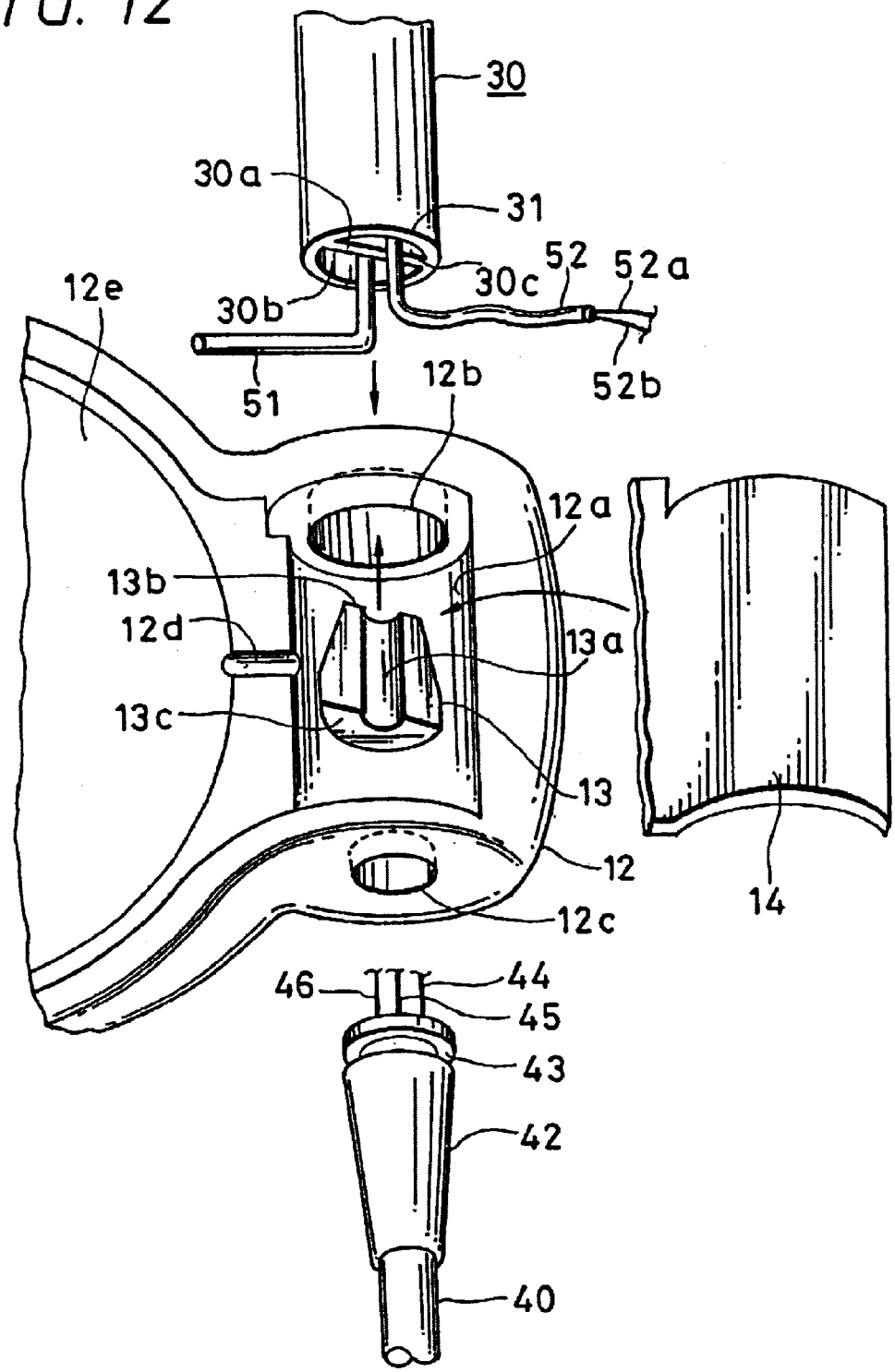
FIG. 12 is a perspective view showing, in dismantled form, a periphery of band fixing part of a housing on one side of a headphone apparatus according to a second embodiment of the present invention.
Figure 13:
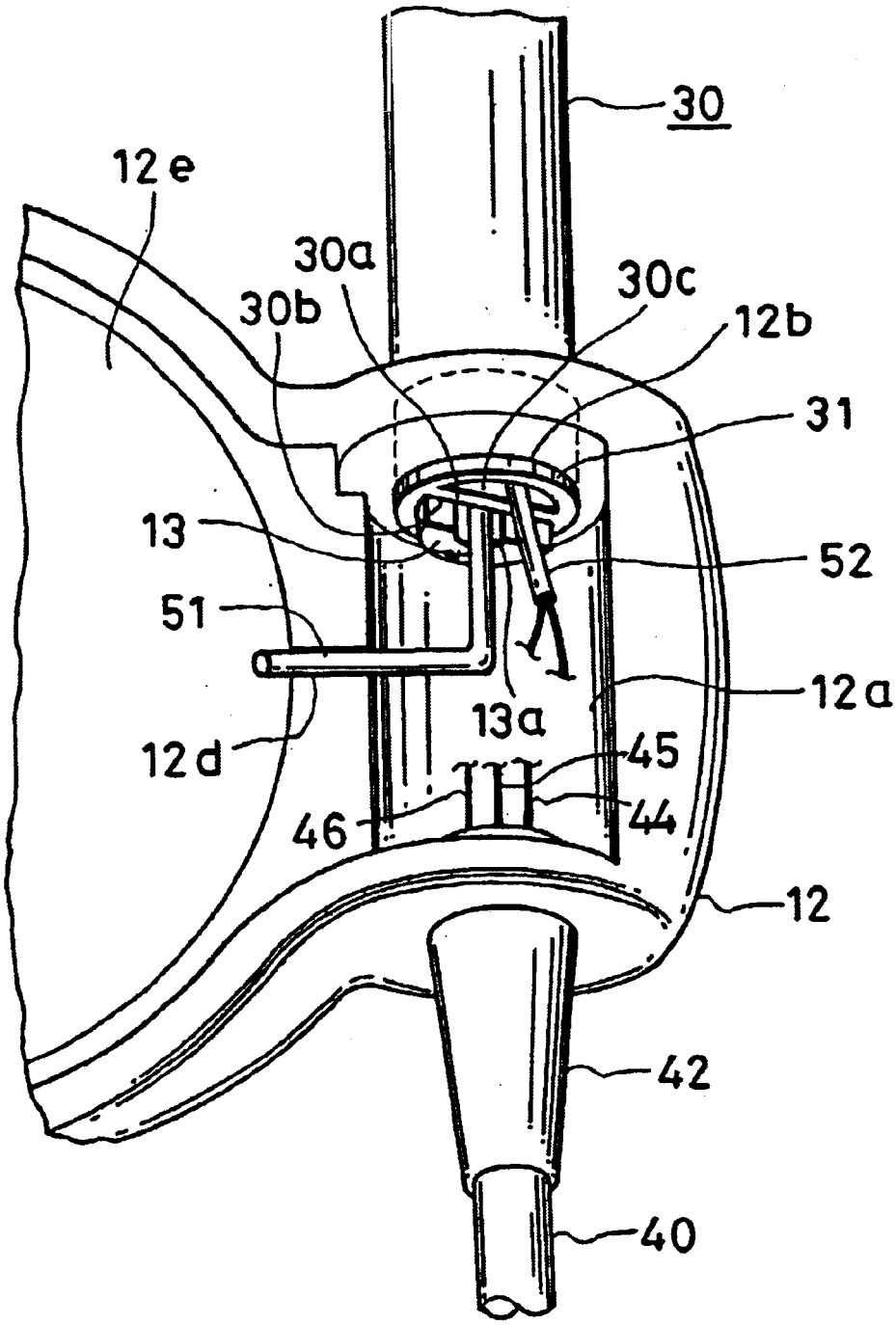
FIG. 13 is a perspective view showing the band fixing part shown in FIG. 12 once the band fixing part has been assembled.

FIG. 12 shows the internal construction of the band connector 12 of the left housing 10 of the present embodiment in a disassembled form, while FIG. 13 shows the band connector 12 once it has been assembled. FIGS. 12 and 13 are drawings showing the band connector 12 of the housing as is seen from the opposite side of FIG. 11, with a driver (not shown in the drawing) that is supplied with an audio signal and outputs sound being arranged in a round driver receptacle 12*e* (only part of which is shown in FIGS. 12 and 13) that is adjacent to the band connector 12.

A cylindrical space 12*a* is formed on the inside of the band connector 12. The surface (the upper surface in FIG. 12) of the space 12*a* is open, with a cover member 14 being attached over the space 12*a* so as to form a completely closed cylindrical space. A band-connecting through-hole 12*b* that passes through to the outside is provided at the upper end of the cylindrical space 12*a*, while a signal wire-connecting through-hole 12*c* that passes through to the outside is provided at the lower end of the cylindrical space 12*a*. A bushing 42 of the cord 40 is inserted into and fixed to the signal wire-connecting through-hole 12*c*. In more detail, a stepped part 43 is formed in the bushing 42 as shown in FIG. 12, so that when the bushing 42 is pressed into the through-hole 12*c*, the stepped part 43 engages the through-hole 12*c* to attach the bushing 42. By having the bushing 42 attached in this way, the signal wires 44, 45, and 46 that extend beyond the end of the cord 40 are positioned in the space 12*a* on the inside of the band connector 12.

A band engaging groove 12*d* is also formed between the space 12*a* and the driver receptacle 12*e*. It should be noted that when the cover member 14 is attached over the space 12*a*, the cover member 14 is positioned over the groove 12*d* so as to cover the groove 12*d*.

A fixing member 13 that is shown in FIG. 12 is used when attaching the tube 30 and the band 51 on the inside of the tube 30 of the present embodiment to the band connector 12 of the housing 10. This fixing member 13 can be formed out of a synthetic resin, for example, and is in the form of a wedge-shaped cone being split in half, with a front end 13*b* (shown at the top in FIG. 12) of the fixing member 13 having a smaller diameter than the through-hole 12*b* and a back end 13*c* (shown at the bottom in FIG. 12) of the fixing member 13 having a larger diameter. However the difference in diameter (width) between the front end 13*b* and the back end 13*c* is relatively small. Since the fixing member 13 is semi-circular, a flat side is formed opposite the curved side, with a continuous groove 13*a* being formed from the front end 13*b* to the back end 13*c*. This groove 13*a* is deep enough for at least the wire material forming the band 51 to pass through the groove 13*a*.

The following describes, with reference to FIGS. 12 and 13, the state in which the tube 30 and the band 51 are fixed to the band connector 12 of the left housing 10 that is described above. As mentioned above, in the present embodiment the band 51 passes through a first space 30*b* in the tube 30 produced by the bulkhead 30*a* and the cord 52 passes through a second space 30*c* in the tube 30 produced by the bulkhead 30*a*. The end of the band 51 and the cord 52 extend beyond the end 31 of the tube 30. The end of the band 51 is bent by 90 in advance. As one example, two signal wires 52*a* and 52*b* can be bundled in the cord 52.

Here, it is assumed that the end 31 of the tube 30 has been inserted from the outside of the housing 10 into the through-hole 12*c*, with the end of the cord 52 and the end of the band 51 being positioned in the space 12*a*. As shown in FIG. 13, the end of the band 51 that is bent by 90 engages the band-engaging groove 12*d* so that the band 51 is supported by the groove 12*d*. The signal wires 52*a* and 52*b* provided in the cord 52 are connected to signal wires 44, 45, and 46 in a cord that is attached to the band connector 12 of the housing 10. These signal wires may be connected using circuit components, such as a small substrate.

The end 31 of the tube 30 protrudes slightly from the through-hole 12*c* into the interior of the space 12*a*, with a front end 13*b* of the fixing member 13 being pressed into the first space 30*b* at the end 31 of the tube 30 from the space 12*a* side. When doing so, the band 51 is arranged in the groove 13*a*.

FIG. 13 shows the fixing member 13 once it has been pressed in. In this state, half (the first space 30*b* side) of the tube 30 is sandwiched between the wall of the through-hole 12*b* and the fixing member 13, so that the end 31 of the tube 30 is fixed in the through-hole 12*b* of the band connector 12. As a result, even if the tube 30 is subjected to a pulling force, the tube 30 is prevented from coming out of the through-hole 12*b* of the band connector 12 on the housing 10, thereby stopping the band 51 and cord 52 that are covered by the tube 30 from becoming exposed. In the present example, the construction functions sufficiently to fix the tube, even though the fixing member 13 presses against only the first space 30*b*-side that composes around half of the tube 30 and no fixing member presses against the second space 30*c*-side.

Like the headphone apparatus of the first embodiment of the present invention, the construction of the present embodiment that is described above stops the band and cord that are covered by the tube from becoming exposed, thereby improving the appearance of the headphone apparatus. In addition, other problems such as a break in the cord that occurs when the end of the tube comes out of the housing can be avoided. Since the fixing member 13 only has to be pressed into the tube in the through-hole, no space is required by the fixing construction, so that the band connecting member can be realized by a small construction and a corresponding reduction can be made in the size of the headphone apparatus.

Also, with the present embodiment, the tube 30 is formed so as to be partitioned into a first space 30*b* and a second space 30*c*, with the band 51 and the cord 52 separately passing through these spaces 30*b* and 30*c*. This means that when the tube 30 is fixed using a semi-circular fixing member 13, the cord 52 is definitely protected from being squeezed by the fixing member 13. Putting this another way, while it is possible to provide a groove 13*a* for allowing the band to pass and a similar groove for allowing the cord 52 to pass in the fixing member 13 so as to protect the cord 52 from being squeezed by the fixing member 13, during assembly it is necessary to ensure that the cord 52 is properly passed through the groove. This means that the cord needs to be positioned carefully during the assembly process. With the present embodiment, however, the inside of the tube 30 is partitioned into the first space 30*b* and the second space 30*c*, with the fixing member 13 only being pressed into the first space 30*b*. The cord 52 in the second space 30*c* therefore automatically assumes a position where it is not squeezed, which facilitates the assembly process for the headphone apparatus.

Also, by using a tube 30 that is partitioned into a first space 30*b* and a second space 30*c* as described in the present embodiment, the cord 52 can be prevented from becoming wound around the band 51 inside the tube 30, so that a break in the cord 52 can be reliably prevented.

Figure 14:
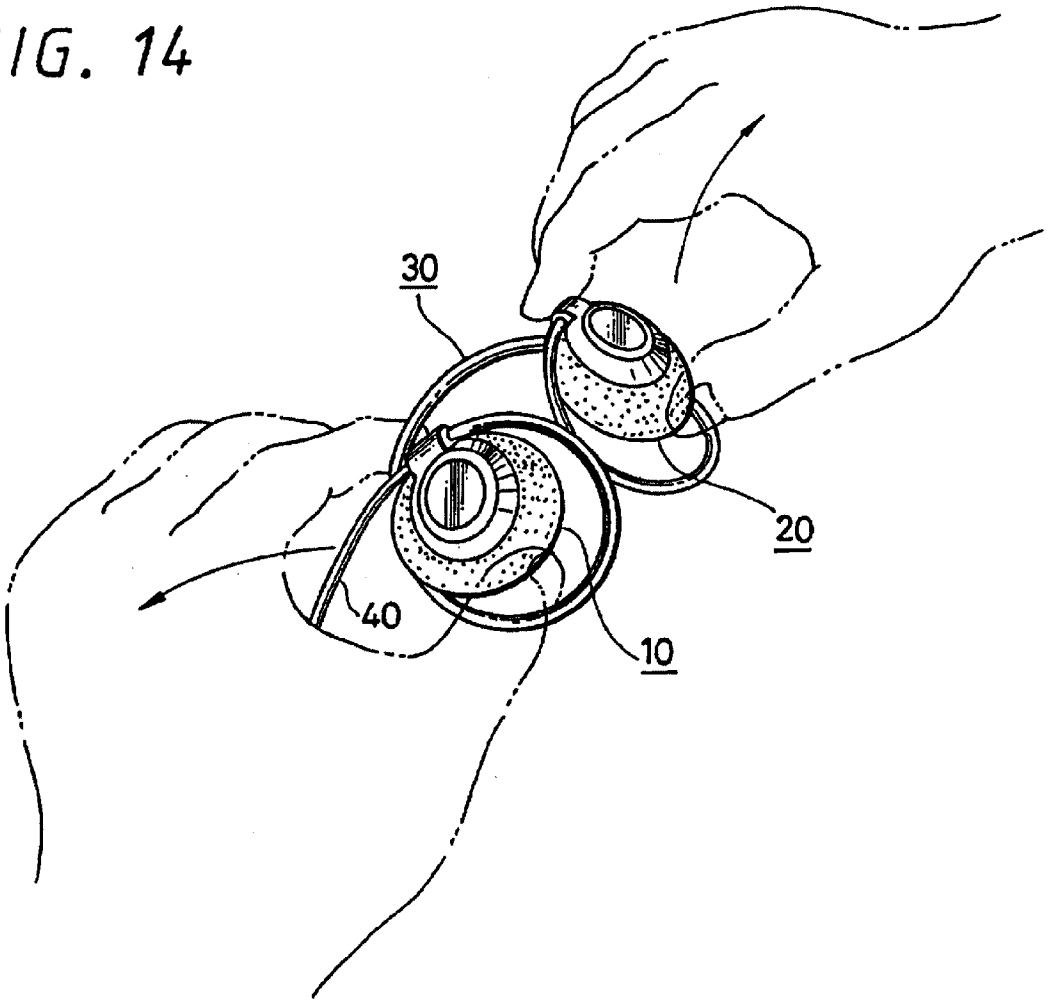
FIG. 14 is a perspective view showing one example of how a headphone apparatus according to a second embodiment of the present invention is held.
Figure 15:
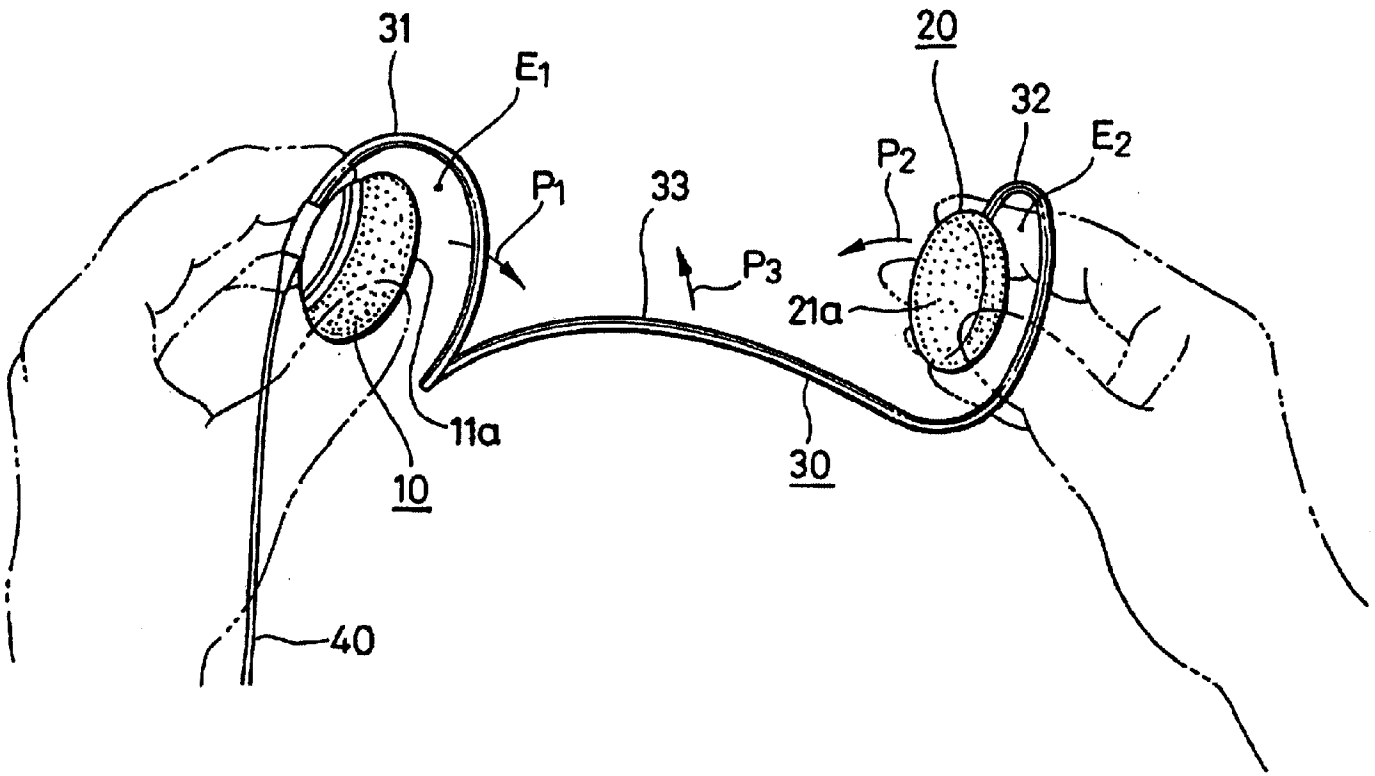
FIG. 15 is a perspective view showing one example of how a headphone apparatus according to a second embodiment of the present invention is stretched when a listener puts on the headphone apparatus.

The following describes, with reference to FIGS. 14 to 16, how a listener puts on the headphone apparatus of the present embodiment that is shown in FIGS. 10 to 13 and described above. When the listener puts on the headphone apparatus of the present embodiment, as shown in FIG. 14, the listener first grasps the left housing 10 and the right housing 20 with his/her left and right hands with the surfaces of the left housing 10 and the right housing 20 (which is to say, the sides that are opposite the sides from which sound is outputted by the drivers) pointing upward and pulls the two housings 10 and 20 apart. As the distance between the housings 10 and 20 increases, the tube 30 (and the band inside the tube) are stretched, so that as shown in FIG. 15, a sound outputting surface 11*a* of the left housing 10 and a sound outputting surface 21*a* of the right housing 20 end up facing one another with a distance of around 20 cm between them.

When the tube 30 is stretched in the state shown in FIG. 15, forces act upon the band inside the tube 30 to restore the band to its original form. As shown by the arrows P1, P2, and P3 in FIG. 15, these forces can be roughly split up into forces P1 and P2 that try to return the housings 10 and 20 towards their original positions and a force P3 that tries to return a central part 33 of the tube 30 from its stretched state to its original curved position.

When the band is stretched as shown in FIG. 15, a gap E1 that is big enough for the left outer ear of the wearer (i.e., the listener) to enter is produced between the housing 10 and one end 31 of the tube that is bent in the shape of a curve with a relatively small radius. In the same way, a gap E2 that is big enough for the right outer ear of the wearer (i.e., the listener) is produced between the housing 10 and the other end 32 of the tube.

With the band in the stretched state as shown in FIG. 15, the wearer places the headphone apparatus behind his/her head, an upper part of the wearer's left outer ear is inserted into the gap E1 described above, an upper part of the wearer's right outer ear is inserted into the gap E2 described above, and the ends 31 and 32 of the tube 30 are above and behind the wearer's right and left outer ears so that the headphone apparatus is supported with the housings 10 and 20 positioned on the fronts of the left and right outer ears of the wearer.

Figure 16A:
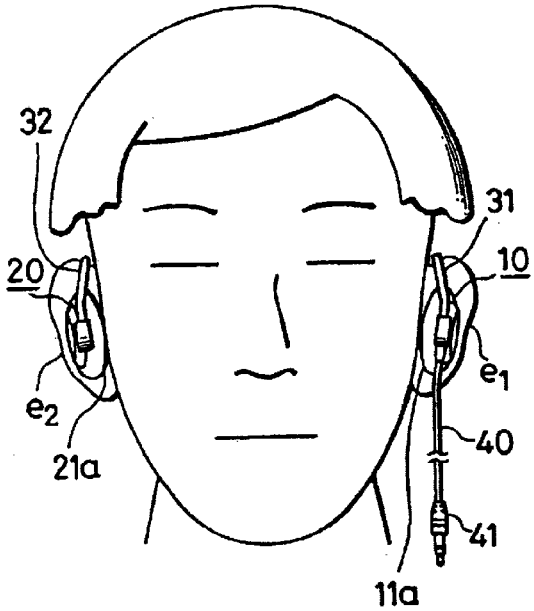
FIG. 16A is an elevational view.
Figure 16B:
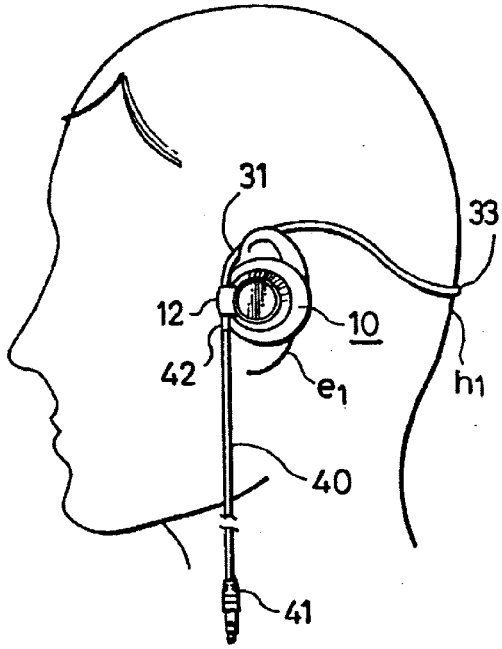
FIG. 16B is a side view and FIG. 16C is a top plan view.
Figure 16C:
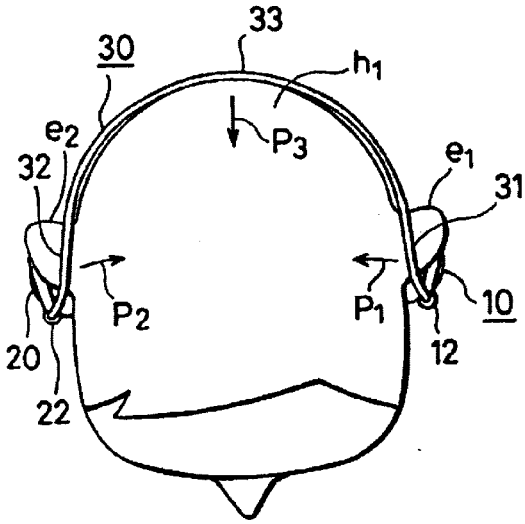

FIG. 16 shows three views of how the headphone apparatus is worn on the head of the listener as described above. As shown in FIG. 16A, when looking from the front, the left housing 10 is positioned on the front of the listener's left outer ear e1, while the right housing 20 is positioned on the front of the listener's right outer ear e2. As shown in FIGS. 16B and 16C, the housings 10 and 20 are supported in these positions by the ends 31 and 32 of the tube 30 that are positioned between the upper parts of the listener's left outer ear e1 and e2 and the listener's head.

When the headphone apparatus is worn on the listener's head as shown in FIG. 16, the forces of the stretched band (shown in FIG. 15 by the arrows P1, P2, and P3) that try to return from the state shown in FIG. 16 results in the headphone apparatus fitting snugly on the listener's head. Putting this another way, as shown in FIG. 16C where the headphone apparatus is shown from above, the force shown as P1 in FIG. 15 acts as a force that presses the left housing 10 towards the center of the listener's head and so presses the left housing 10 onto the listener's left outer ear e1. In the same way, the force shown as P2 in FIG. 15 acts as a force that presses the right housing 20 towards the center of the listener's head and so presses the right housing 20 onto the listener's right outer ear e2. Also, as shown in FIGS. 16B and 16C, the force shown as P3 in FIG. 15 that acts on the central part 33 of the tube 30 acts so as to press against the back h1 of the listener's head when the headphone apparatus is being worn, so that no gap is produced between the central part 33 of the tube 30 and the back h1 of the listener's head.

It should be noted that taking a headphone apparatus that is being worn as shown in FIG. 16 off the listener's head results in the band in the tube 30 returning to its original wound state, so that the headphone apparatus automatically returns to the round form shown in FIG. 10.

By using the construction described above and shown in FIGS. 12 and 13 to form the band connector of a headphone apparatus that can be favorably worn by a listener as described above and stored in a compact form when not in use, the tube that covers the band can be simply and favorably fixed. In particular, when a headphone apparatus has the form described in the present embodiment, a compact construction where the band is directly connected to the housings is used, so that the band connectors of the housing can be made extremely small, which assists in the miniaturization of the headphone apparatus.

It should be noted that the forms of the various components, such as the housings and the band, of the headphone apparatus of the embodiments that are described above are only examples, so that other forms may be used for the components. In more detail, in the first embodiment that is described above, a construction is used where the bands are indirectly connected, via sliders and connecting members in the form of resin housings to which both ends of the bands are fixed, to the housings that accommodate the drivers, while in the second embodiment, a construction is used where the band is directly connected to the housings that accommodate the drivers, though the present invention may be used in other types of headphone apparatus where a band that is covered by a tube is attached.

In the same way, the fixing members of the embodiments described above are merely examples and so are not restricted to the forms shown in FIG. 8 and in FIG. 12. In more detail, provided that the fixing member is inserted (pressed) into an end of the tube and presses the tube against the inside walls of the through-hole so as to stop the tube from coming out, the pressing member may have any form.

In the second embodiment described above, the inside of the tube 30 is partitioned by a bulkhead 30*a* into the first space 30*b* and the second space 30*c* and the band 51 and the cord 52 are separately arranged into these spaces for the mechanism where the ends of the tube are fixed by fixing members. However, the same kind of tube construction may be used for a tube that connects that left and right housings, etc., of a headphone apparatus where such fixing members are not used. By using this kind of tube, the cord (signal wire) known as a "crossing wire" that connects the left and right housings of a headphone apparatus can be reliably prevented from becoming wound around the band and the like on the inside of the tube.

Also, in the above example, when a tube in which two spaces are formed is used, the band is passed though one space and the cord is passed through the other space, though a different arrangement may be used. As one example, when a plurality of cords are to pass through the tube, one cord and the band may pass through one space, with the remaining cords passing through the other space. By doing so, problems such as the entanglement of the cords that pass through the tube can be reliably avoided.

Industrial Applicability

According to the present invention, when a fixing member is merely inserted into an end of the tube, the end of the tube becomes held between the fixing member and the through-hole, so that even if a pulling force acts upon the tube, the end of the tube does not come out of the case. As a result, exposure of the band and the like that are covered by the tube can be prevented, which improves the appearance of the headphone apparatus and prevents problems, such as a break in the cord, that are caused by the end of the tube unit coming out of the case.

In addition, one or a plurality of grooves are formed in the fixing members in a direction that passes through the tube, so that by passing the band and the signal wires through such grooves, the band, etc., is not pressed by the fixing members and only the tube is pressed against the housings, making the construction effective at preventing the tube from coming out of the housings.

Further, in the headphone apparatus disclosed in claim 1, a signal wire that provides an audio signal to the drivers is passed through the tube, the fixing members are shaped so as to press only part of the tube, and the cord is passed through parts of the tube that are not pressed by the fixing members. As a result, the tube can be pressed against the housings without pressing the cord, making the construction effective at preventing a tube, through which a band and a cord pass, from coming out of the housings.

Furthermore, according to the present invention, the tube that covers a band connecting two housings that compose a headphone apparatus has two internal spaces, so that by using these two spaces, a band and signal wires can be arranged separately. This prevents problems, such as the signal wires becoming wound around the band.

a band is passed through one of the spaces in a tube and a signal wire is passed through the other space, so that the signal wire can be effectively prevented from becoming wound around the ban.

What is claimed is:

1. A headphone apparatus including two housings that are worn close to left and right ears of a listener and to which drivers for outputting sounds corresponding to audio signals are respectively attached, a band composed of an elastic body that connects the two housings, and a tube that covers the band, the headphone apparatus comprising:

a through-hole into which the band and tube are inserted provided in each of the two housings; and a pair of fixing members that respectively inserted from inside the housing into one end of the tube that has been inserted into the through-holes so as to press an outer side of the end of the tube against the through-holes, wherein the fixing member is tapered in a direction of insertion into the tube.

2. The headphone apparatus according to claim 1, wherein two grooves are formed in each of the fixing members in the direction of insertion into the tube, wherein the band passes through one of the two grooves and a wire carrying the audio signals passes through the other of the two grooves.

3. A headphone apparatus, comprising:

two housings that are worn close to left and right ears of a listener and to which two drivers for outputting sounds corresponding to audio signals are respectivel attached;

a band composed of an elastic body that connects the two housings;

a tube that covers the band and that has ends that fit into the two housing and that has an internal space partitioned in a lengthwise direction by a longitudinal bulkhead into two longitudinal spaces over a length of the tube, wherein the band resides in one of the two longitudinal spaces;

a signal wire that connects the two drivers, wherein the signal wire resides in the other of the two longitudinal spaces; and two fixing members that are inserted into respective ends of the tube fitted into the two housings.

4. The headphone apparatus according to claim 3, wherein the two fixing members are inserted into the one longitudinal space of the two longitudinal spaces in the tube in which the band resides.

* * * * *